US007934446B2

(12) United States Patent
Engel et al.

(10) Patent No.: US 7,934,446 B2
(45) Date of Patent: May 3, 2011

(54) FIREARM

(75) Inventors: Heinz-Eckhard Engel, Battenberg/Eder (DE); Wolfgang Schmid, Dornstadt (DE)

(73) Assignee: H. Krieghoff GmbH, Ulm (DE)

( * ) Notice: Subject to any disclaimer, the term of this patent is extended or adjusted under 35 U.S.C. 154(b) by 0 days.

(21) Appl. No.: 12/068,046

(22) Filed: Feb. 1, 2008

(65) Prior Publication Data

US 2008/0184607 A1 Aug. 7, 2008

(30) Foreign Application Priority Data

Feb. 2, 2007 (DE) ..... 10 2007 006 107

(51) Int. Cl.
*F41A 5/16* (2006.01)

(52) U.S. Cl. ..... 89/161; 42/75.02; 42/75.03; 42/75.04; 42/74; 89/162

(58) Field of Classification Search ..... 89/161, 89/162

See application file for complete search history.

(56) References Cited

U.S. PATENT DOCUMENTS

| | | | | |
|---|---|---|---|---|
| 1,396,832 | A * | 11/1921 | Graham | 89/145 |
| 2,699,006 | A * | 1/1955 | Maerk | 42/10 |
| 2,835,998 | A * | 5/1958 | Maerk | 42/10 |
| 2,865,255 | A * | 12/1958 | Marsh | 89/163 |
| 3,892,082 | A * | 7/1975 | Domhan | 42/11 |
| 7,347,021 | B1 * | 3/2008 | Jones | 42/10 |
| 7,571,671 | B2 * | 8/2009 | Engel | 89/161 |
| 7,866,078 | B1 * | 1/2011 | Beretta | 42/75.03 |

FOREIGN PATENT DOCUMENTS

| | | |
|---|---|---|
| DE | 106939 | 7/1896 |
| DE | 2 263 378 | 7/1974 |
| DE | 203 19 451 U1 | 5/2005 |
| GB | 756769 | 9/1956 |

* cited by examiner

*Primary Examiner* — Troy Chambers
*Assistant Examiner* — Samir Abdosh
(74) *Attorney, Agent, or Firm* — Clark & Brody

(57) ABSTRACT

The invention relates to a firearm (10), in particular a single or multi-shot repeating rifle comprising a stock (11), a barrel (30) axially displaceable relative to the stock (11) and resting on or in a linear guide (20), a cartridge chamber to receive a cartridge being constituted in said barrel, further a breech (40) fitted with a breech cap (41) to seal the cartridge chamber and axially affixable in the barrel end (32) when the firearm (10) is closed, and further a locking unit (80) to lock the firearm into the closed position. The linear guide (20) comprises at least one guide rod (21), guide fork or the like linked or linkable to the barrel (30) and guided in sliding manner within the stock (11). This design leads to a compact and easily manufactured firearm with a slender and attractive appearance. The firearm (10) furthermore is made of fewer parts, resulting in simple disassembly and small shipping size.

23 Claims, 1 Drawing Sheet

FIREARM

Figure 1:
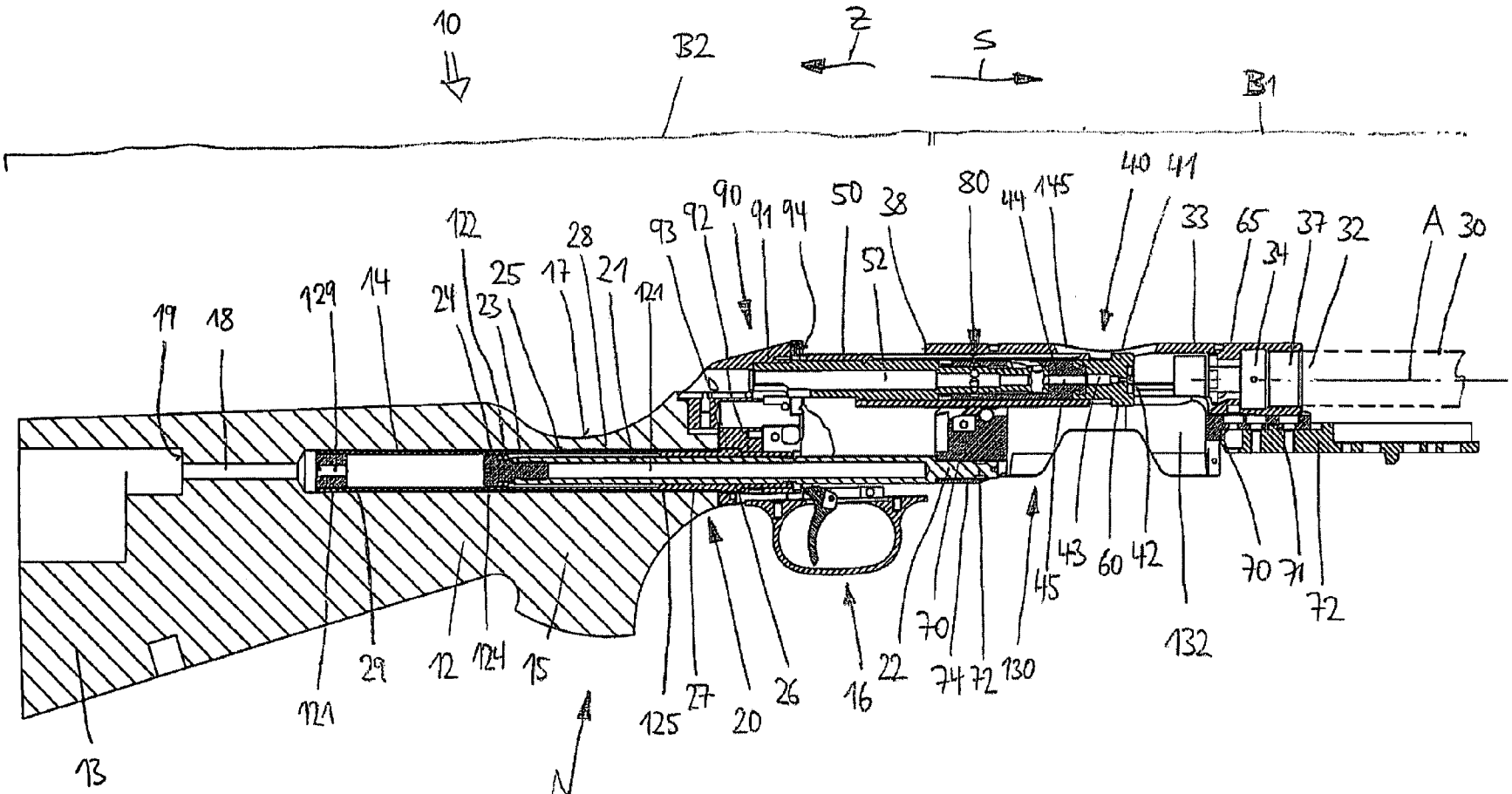

The present invention relates to a firearm defined in the preamble of claim 1.

Firearms such as rifles and shotguns are known of which the loading motion is carried out by means of the front stock. For that purpose this front stock rests in axially displaceable manner in a guide parallel to the barrel and can be manually displaced to-and-fro between two end positions. The axial guide is enclosed in partly covered manner by the front stock which usually is cross-sectionally U-shaped. Such a shape however usually entails a bulky outer contour denying the front stock-actuated long weapons—which when fitted with a cartridge magazine also are called pump-action weapons—an otherwise slender, elegant appearance. This drawback applies both to those firearms of which the barrel is fixed in place and to those that are fitted with a longitudinally displaceable barrel, where perforce the barrel and the front stock are rigidly joined to each other (see for instance German Offenlegungsschrift 22 63 378 and German Gebrauchsmuster U1 203 19 451. The dimensions of longitudinal guides configured in the front stock zone frequently will clearly exceed the package dimensions of take-apart shoulder arms.

The objective of the present invention is elimination of the above and other drawbacks and to create an easily handled firearm fitted with a longitudinally displaceable barrel and of compact design. The mechanism as a whole shall be constituted by a minimum of parts that are economically manufactured and assembled. Moreover the firearm shall be easily disassembled and on account of its compact design can be easily stowed.

As regards a firearm—in particular a single or multi-shot repeating rifle fitted with a stock, with a barrel which is axially displaceable relative to the barrel or rests in a linear guide, said barrel comprising a chamber receiving a cartridge, further a breech block to lock the firearm in its closed position—the invention provides that the linear guide comprises at least one guide rod, guide fork or the like that is linked or linkable to the barrel and that is guided in sliding manner within the stock. This design allows utmost firearm compactness, the firearm always being easily handled on account of its easily implemented displacements.

The stock is sub-divided into a rear and a front stock, the guide rod in the rear stock being guided in sliding manner and preferably parallel to the barrel axis. As a result the entire linear guide does not require extra any separate space within the firearm, and in particular the guide rod no longer need be covered by the front stock. Instead this front stock may be independently designed to be slender. Nevertheless the barrel will be driven by means of the front stock inside the linear guide, said front stock—contrary to the case of the commercially offered pump action guns—always being in a rear (marksman) end position when the weapon is locked. This feature offers the advantage that the leveled weapon shall always be kept closed by the guiding hand, as a result of which the perception of a single-part stock is created. The guide rod in this process disappears completely into the rear stock, that is, the entire linear guide is not visible from the outside. The conventional appearance of hunter guns is basically preserved. However, in spite of using barrels of standard lengths, the length of the firearm of the invention is substantially shortened relative to conventional designs, offering further handling improvement of the gun.

The cross-section of the guide rod is substantially round or polygonal, for instance square. Together with a matching borehole in the rear stock, said square cross-section assures barrel irrotationality. The circular cross-section is an economical variation which is of which the manufacture is simpler and more advantageous. The barrel irrotationality is assured by the breech, for instance when the breech cap is guided parallel to the guide rod in a breech muff at the barrel end.

In an advantageous design, the guide rod is guided in a tube preferably situated in the rear stock. This tube not only assures reliable and permanently dimensionally stable guidance, in addition it simplifies the design of the firearm. The rear stock offers ample space to receive the tube and hence the linear guide. Affixation too is simple.

The firearm is advantageously handled by providing at least one mechanical guide-bar stop. This stop defines at least the front open position of the firearm, whereby the breech always can be opened accurately and reproducibly. Preferably this mechanical stop is an axial mechanical stop present in and/or on the tube.

The present invention also provides that the breech cap be configured at or in a housing firmly affixed to the stock. At the instant of firing, the breech cap then shall always be mechanically interlocking with the barrel, i.e. the breech muff, as a result of which the recoil of a cartridge charge is transmitted concentrically with the barrel axis, hence free of torque and tipping, into the housing. When the firearm is closed, said housing offers a rest of constant height to the firearm, whereby the recoil is transmitted along the barrel, directly into the housing and from there through the stock into the marksman's shoulder. In this manner the breech muff, breech cap and housing assure optimal force transmission within the firearm.

Such desirable force transmission is further supported by firmly connecting the tube to the housing. Such connection is implemented by an additional support within the rear stock, as a consequence of which even tipping torques acting on the housing always shall be reliably compensated.

In a further significant embodiment mode of the present invention, the housing may be affixed by means of the tube in the rear stock. Consequently the tube serves a double purpose, on one hand providing the guide rod with accurate and reliable guidance when the firearm is opened and closed. On the other hand the housing may be affixed by means of the tube within the rear stock, as a result of which fasteners are needed neither in the region of the breech nor in that of the trigger unit. The design and assembly of the firearm are substantially simplified. Conceivably, the housing mechanically interlocked with the rear stock may be affixed directly by means of the tube, for instance using screws, pressing and the like. However the tube which preferably is firmly affixed to the housing may itself be affixed in the rear stock, for instance using a (stock) screw, as a result of which the housing is simultaneously and automatically fixed in place at the same time.

In a further embodiment mode of the present invention, besides supporting the barrel, the guide rod supports also the front stock and—when the fire arm is a multi-shot repeating rifle—also a magazine which advantageously comprises a magazine box for a plug-in magazine. The magazine is always carried along by being affixed to the barrel and the front stock during the repeating action. It is designed and configured in a manner that it will be situated above the trigger unit in the firearm's closed position while being freely accessible from below in the firearm's open position. This feature too advantageously affects the firearm's design length, which is extremely compact in the closed position. As regards the open position, the magazine, and in particular the plug-in magazine, on the other hand is freely accessible, substantially simplifying firearm handling.

Advantageously the barrel, front stock and magazine constitute a first sub-assembly connected or connectable to the guide rod. At the same time the rear stock, guide rod, tube and housing with the breech cap constitute a second sub-assembly, whereby the firearm as a whole, as needed—for instance for shipping or cleaning—can be disassembled into two parts. The guide rod can be separated preferably by depressing a knob, and therefore with no need for tools, from the first sub-assembly and always remains in the tube of the second sub-assembly, as a result of which each of the two firearm parts is devoid of projecting and hence interfering elements. The firearm can be taken apart and packed very compactly and conveniently and be rapidly re-assembled any time.

The lock locking the firearm can be configured in the region of the breech or in that of the linear guide.

The guide rod is tubular at least segment-wise, thereby saving weight and increasing the dimensional stability of the linear guide.

In a further embodiment mode of the present invention, at least two guide rods are configured parallel to and/or superposed on each other. This feature offers irrotationality and even greater guidance stability.

The breech substantially is axially and/or rotationally symmetric to the barrel axis. To affix the breech cap in the barrel end, the breech furthermore comprises locking elements acting in the radial and/or axial directions in the barrel end and engaging, or being engageable with, appropriate breech elements in the barrel end when the barrel is longitudinally displaced. For that purpose the breech cap rests in axially displaceable and/or rotatable manner on a support coaxial with the barrel axis, said support being affixed on or in the housing solidly joined to the stock.

Together with the longitudinally displaceable barrel, the overall axially symmetrical and/or rotationally symmetrical design of the breech allows extraordinary firearm simplicity and compactness. In particular the full breech may be designed having only a few parts which—just as the barrel per se—may be manufactured on a lathe. This feature is advantageous beyond the manufacture per se. The firearm may be rapidly assembled and is able to operate reliably on account of displacement sequences which are carried out comparatively easily. Wear and malfunction are low.

The radially respectively radially operating breech components that can be made to engage the barrel end merely displacing the barrel longitudinally also contribute to the above advantages. Actuation of externally projecting levers or carrying out separate manual or adjusting movements no longer are required, this feature substantially simplifying firearm handling.

The present invention offers the further advantage that upon firing a shot, the axially and/or rotationally design of the invention precludes both tipping motions and torques that might degrade firing accuracy. Supporting the barrel in the housing instead ensures there always shall be optimal force transmission along the barrel axis, the recoil of the cartridge charge being transmitted directly from the barrel into the housing and from there by means of the stock into the marksman's shoulder.

Further features, particulars and advantages of the present invention are defined in the claims and elucidated in the description below of illustrative embodiment modes and in relation to the appended drawing. This drawing shows a side-view of a partial section of a firearm of the invention.

FIG. 1 shows a firearm denoted in its whole by the reference 10 and in the form of a multi-shot repeating rifle. This firearm comprises a stock 11 with a rear stock 12 fitted at its rear with a gun butt 13 and merging at its fore into an omitted front stock. An integral gun grip 15 integral with the rear stock 12 is configured between the front stock and the gun butt 13, the gun grip allowing conveniently driving a trigger 16 unit. The trigger unit 16 is firmly affixed to the rear stock 12. For the purpose of firing a shot, said trigger unit is connected by means of an omitted tensioning and release mechanism to a hammer which drives an omitted striking pin.

A gun barrel 30 is mounted above the stock 11 and is displaceably supported by a linear guide 20 in the axial direction A to the trigger unit 16. The linear guide 20 is constituted by a guide rod 21 which is detachably linked to the barrel 30 and which is guided parallel to the barrel axis A in a tube 25. This tube is inserted into the rear stock 12 which is fitted for that purpose with a matching borehole 14 running parallel to the barrel axis A and underneath a thumb trough 17 situated in the region of the gun grip 15.

At its end the barrel 30 bears a substantially tubular breech muff 33 fitted with a threaded borehole 37 into which the barrel 30 is firmly screwed by means of its end 32. Next to the threaded borehole 37, the muff 33 is fitted with a central recess 34 to receive a breech cap 41 that, during firing, seals off a cartridge chamber constituted at the end of the barrel 30, thereby bracing a cartridge to be fired. For that purpose an impact base 42 fitted with an axial borehole 43 for the striker pin is configured at the center of the end face of the breech cap 41. An omitted lateral extraction claw and an omitted, excentric, axially resilient ejector pin serve to eject the residual cartridge after firing the firearm 10. The ejection of the cartridge case takes place through an ejection window 145 fitted in the outer shell of the sealing muff 33.

The breech cap 41 is part of a breech unit 40 and in the present embodiment is a rotary cylinder seal. For that purpose said cap with radial sealing elements 60 at its periphery in the form of an external toothing which can be made to engage—by means of the longitudinal displacement of the barrel 30 and an entailed rotation of the breech cap 41—matching sealing elements 65 in the sealing muff 33. For that purpose said muff is fitted at its inner periphery with an inner toothing matching the outer one, as a result of which at the instant of firing, the firearm 30 always shall be reliably closed.

FIG. 1 furthermore shows the breech cap 41 being detachably affixed to a cylindrical stem 44 comprising a centrally stepped inside borehole 45. In this manner said stem rests in limited axially displaceable manner on a cylindrical support 50 which is coaxial with the axis A of the barrel 30. Said support 50 is affixed in a system housing 90 which is fitted for that purpose with an appropriate recess 91. A center axial borehole 52 in the support 50 receives the spring-loaded striker pin which, when a shot is to be fired, will pierce by one tip the axial borehole 43 in the breech cap 41.

The rear end of the breech muff 33 comprises an impact surface 38 which is concentric with the barrel axis A. In the closed position of the firearm 10, said impact surface rests against the housing 90 which is fitted with a matching mechanical stop surface 94. The housing 90 is open in the shooting direction S and is inserted into the rear stock 12, as a result of which a recoil generated at the instant of firing is directly transmitted to the housing 90 and hence to the rear stock 12.

The breech muff 33 of the barrel 30 is configured above a console 70 solidly joined to said muff, for instance being screwed into it. The console 70 receives a magazine 130 of which the box 132 also is solidly joined to the console 70. The magazine box 132 is open downward to receive an omitted plug-in magazine receiving cartridges to reload the repeating rifle 10. At its front end 71, the console 70 bears an extension arm 72 running underneath the barrel 30 in the direction of firing S. The front stock is affixed to the extension arm 72.

The cross-sectionally circular guide rod 21 of the linear guide 20 tapers at its front end 22 to be connected to the barrel 30 and is plugged by this end 22 into the rear end of the console 70 which faces the rear stock 12. For that purpose the console 70 comprises a recess 74 receiving the rod end 22 in frictional and/or geometrically interlocking manner. The guide rod 21 is affixed to the console 70 either by a detachable screw connection or—substantially simplifying handling—by a detent which snaps automatically or by means of an omitted drive element the guide bar 21 into the console 70, i.e. into latter's recess 74.

The tube 25, which is also cross-sectionally round and is inserted into the rear stock 12, is screwed by its front end 26 facing the barrel 30 into the housing 90. For that purpose the housing 90 is fitted with a matching recess 92 comprising a matching thread 93.

The inside periphery of the tube 25 is stepped, a step 125 subdividing the tube 25 into a front zone 27 and a rear zone 28. Except for a slight play, the inside diameter of the front zone 27 matches the outside diameter of the guide rod 21, whereby said rod shall always be accurately guided within the tube 25. The diameter of the rear zone 28 is slightly larger to receive a stopper 24 inserted into the rear end 23 of the guide rod 21, preferably being screwed into it. For that purpose the rod 21 is fitted at least segment-wise with a core borehole 121 and hence is tubular. A unilateral thread (omitted) affixes the stopper 24 in the guide rod 21.

At its end side, the stopper 24 is fitted with a cylindrical head 124. This head's outside diameter is less than the inside diameter of the rear zone 28 of the tube 25 but larger than the inside diameter of the guide zone 27 in the tube 25. Therefore, as soon as the stopper 24 has been screwed into the guide rod 21, this rod no longer may be pulled forward out of the tube 25. The step 125 of said tube in this manner constitutes an axial stop stopping the guide rod 21. Sealing rings 122 set on the stopper 24 seal off the linear guide 20 and simultaneously act as damping elements when the guide rod 21 together with its stopper 24 hits the mechanical stop 125.

A stopper 121 is forced or screwed into the rear end 29 of the tube 25. Said stopper is fitted with a center borehole 129 comprising an inside thread. A stock screw (omitted) is rotated from the rear into said inside thread and is guided through an axial borehole 18 concentric with the recess 14 in the rear stock 12. The head of the stock screw rests against an offset 19 in the rear stock 12, whereby the screw pulls the tube together with the housing 90 into the rear stock 12 and in this manner affixes both the tube 25 and also the housing 90 in the rear stock 12. Additional fasteners no longer are required. The free space (not discussed further) subtended behind the axial borehole 18 and the offset 19 in the gun butt 13 is closed off by a cover (also omitted).

The locking system 80 (not detailed further herein) locking the firearm 10 preferably shall be configured in the region of the breech 40.

As shown and discussed, the barrel 30, muff 33, the front stock, console 70 and the magazine 130 constitute a first sub-assembly B1, all components being rigidly connected to each other. On the other hand the rear stock 12, the trigger unit 16, guide rod 21, tube 25 and housing 90 together with the breech cap 41 constitute a second sub-assembly B2. The two sub-assemblies B1, B2 on one hand are detachably connected to one another by means of the guide rod 21 and on the other hand are mutually displaceable by means of the linear guide 20, the barrel 30 being able to slide irrotationally between a stop position defined by the axial stop 125 and a rearward stop position defined by one of the stop surfaces 28, 94. Irrotationality is assured by the breech 40 of which the cap 41 never moves out of the breech muff 33 of the barrel 30 but instead always is guided parallel to the linear guide 20.

The guide rod 21 is detachably connected to the sub-assembly B1. Accordingly, when the firearm is in its assembled state, the sub-assembly B1 also supports the barrel 30, the front stock, the console 70 and the magazine 130. At the same time, the firearm 10 can be disassembled any time merely by dissolving the interface 22, 72, the guide rod 21 all the time remaining the tube 25 because the stop 125 prevents the guide rod 21 from sliding out. Accordingly said guide rod may be associated with both the sub-assembly B2 and the sub-assembly B1. However a considerable advantage is attained that on one hand the interface 22, 72 always shall be conveniently accessible when the firearm is open. On the other hand, when the sub-assemblies B1 and B2 are separated from each other, there are no protruding components that might hamper shipping or might break when shipped.

The firearm 10 of the present invention offers another significant advantage in that, when this firearm is closed, the magazine 130 shall be situated above the trigger unit 16, the design length of the firearm 10 being substantially shortened thereby. If on the other hand the barrel 30 is displaced by means of the front stock into its front stop position, the magazine 130 shall be freely accessible in front of the trigger unit 16. The plug-in magazine may be removed from and then reinserted in quick and convenient manner.

Regarding the ensuing operation of the firearm, in particular with respect to the breech 40 or the locking unit 80, the reader is referred to the fully relevant German Ge-Brauchsmuster U1 203 19 451, which corresponds to United States Published Patent Application No. 2005/0188578.

The present invention is not restricted to the above described embodiment modes, indeed it may be varied in many ways. Illustratively the guide rod 21 also may be cross-sectionally triangular and be guided in sliding manner in a matching tube 25. The guide segment 27 of said tube may be substantially longer and for instance it may extend as far as into the gun butt 13. Depending on the size of the firearm 10, two or more guide rods 21 may be appropriate, rather than one, which would be guided in sliding manner parallel to one another and/or superposed on one another in the rear stock 12 and/or in the housing 90. The locking units 80 to lock the firearm 10 optionally may also be constituted in the region of the linear guide 20.

The elucidations so far make clear that in order to overcome the already stated drawbacks of the state of the art, the longitudinal guide 20, 21, 25 of the front-stock sub-assembly B1 was moved into the rear stock (firearm butt 13) and that the linear guide 20 is fitted with at least with one guide rod 21 connected or connectable to the barrel 30, said rod being guided in sliding manner within the rear stock 12. For that purpose said rear stock is fitted with a longitudinal borehole parallel to the barrel and running axially through the rear stock 12 underneath its thumb trough 17. A tube 25 is preferably configured in said trough and acts as a "box or housing screw" to affix the system box 90 to the rear stock 12. The borehole 27, 28 of the tube 25 simultaneously receives the guide rod 21 affixed to the sub-assembly B1 and axially displaceable in said borehole.

In a preferred embodiment mode, the guide rod 21 bears at its front end 22 a magazine box 132 integrated into a console 70, the barrel 30 together with the system sleeve (breech muff 33) being configured again on the top side of said magazine box 132. This design allows using cross-sectionally circular rods and tubes as guide rod systems, the support of the breech cap 41 within the system tube 33 elegantly assuring the otherwise conventional irrotationality.

All features and advantages, including design details, spatial configurations and procedures, implicit and explicit in the claims, specification and drawing, may be construed being part of the present invention per se or in arbitrary combinations.

The invention claimed is:

1. A firearm (10), in particular a multi-shot repeating rifle, comprising:

a stock (11), having a rear stock (12) fitted at its rear with a gun butt (13) and merging at its fore into a front stock, a barrel (30), having at its end a breech muff (33), said breech muff (33) being fitted with a central recess (34) to receive a breech cap (41) of a breech bolt (40) and said breech muff (33) of the barrel (30) is configured above a console (70) solidly joined to said muff (33), said barrel (30), said breech muff (33), said console (70) and said front stock resting in axially displaceable manner relative to the rear stock (12) on or in a linear guide (20), said linear guide (20) having a guide rod or guide fork (21) connected or connectable to the barrel (30) by plugging an end (22) of said guide rod or guide fork (21) is guided in a non-rotational sliding manner in a tube which is configured in the rear stock, such that the guide rod runs parallel to the barrel axis (12), said guide rod or guide fork (21) is guided in sliding manner in a tube (25) which is configured in the rear stock (12), said breech cap (41), during firing, seals off a cartridge chamber constituted at the end of the barrel (30), thereby embracing a cartridge to be fired, said breech cap (41) being axially affixable in the barrel end (32) when the firearm (10) is being closed; and a locking unit (80) to lock the firearm in its closed position.

2. Firearm as claimed in claim 1, characterized in that the cross-section of the guide rod (21) is substantially circular or polygonal.

3. Firearm as claimed in claim 1, characterized in that it comprises at least one mechanical stop (125) for the guide rod (21).

4. Firearm as claimed in claim 3, characterized in that the stop (125) is constituted in or on the tube (25).

5. Firearm as claimed in claim 1, characterized in that the breech cap (41) is mounted at or in a housing (90) firmly joined to the stock (11).

6. Firearm as claimed in claim 5, characterized in that a tube (25) is firmly connected to the housing (90).

7. Firearm as claimed in claim 5, characterized in that the housing (90) can be affixed by means of a tube (22) in the rear stock (12).

8. Firearm as claimed in claim 1, characterized in that the guide rod (21) supports the barrel (30).

9. Firearm as claimed in claim 1, characterized in that the guide rod (21) supports the front stock.

10. Firearm as claimed in claim 1, characterized in that the guide rod (21) supports a magazine (130).

11. Firearm as claimed in claim 10, characterized in that the magazine (130) comprises a magazine box (132) for a plug-in magazine.

12. Firearm as claimed in claim 10, characterized in that the barrel (30), the front stock and the magazine (130) constitute a first sub-assembly (B1).

13. Firearm as claimed in claim 12, characterized in that the guide rod (21) is detachably connected to the sub-assembly (B1).

14. Firearm as claimed in claim 5, characterized in that the rear stock (12), the guide rod (21), a tube (25) and the housing (90) together with the breech bolt and breech cap (41) constitute a second sub-assembly (B2).

15. Firearm as claimed in claim 1, characterized in that the locking unit (80) locking the firearm (10) is configured in the region of the breech bolt.

16. Firearm as claimed in claim 1, characterized in that the locking unit (80) locking the firearm (10) is configured in the region of the linear guide (20).

17. Firearm as claimed in claim 1, characterized in that the guide rod (21) is at least segment-wise tubular.

18. Firearm as claimed in claim 1 characterized by at least two guide rods (21) running parallel to or superposed on each other.

19. Firearm as claimed in claim 1, characterized by the breech bolt being substantially axially or rotationally symmetrical to the barrel axis (A) and by radial and/or radially acting sealing elements (60) to affix the breech cap (41) in the barrel end (32), said sealing elements (60) engaging—when the barrel (30) is longitudinally displaced—matching sealing elements (65) in the barrel end (32).

20. Firearm as claimed in claim 1, characterized in that the breech cap (41) rests in axially displaceable and/or or rotatably on a support (50) coaxial with the barrel axis (A), said support being configured in stationary manner at or in the housing (90) which is firmly affixed to the stock (11).

21. Firearm as claimed in claim 1, wherein the console (70) comprises a recess to receive the end (22) of the guide rod or guide fork (21).

22. A firearm (10), in particular a single-shot repeating rifle, comprising:

a stock (11), having a rear stock (12) fitted at its rear with a gun butt (13) and merging at its fore into a front stock, a barrel (30), having at its end a breech muff (33), said breech muff (33) being fitted with a central recess (34) to receive a breech cap (41) of a breech bolt (40) and said breech muff (33) of the barrel (30) is configured above a console (70) solidly joined to said muff (33), said barrel (30), said breech muff (33), said console (70) and said front stock resting in axially displaceable manner relative to the rear stock (12) on or in a linear guide (20), said linear guide (20) having a guide rod or guide fork (21) connected or connectable to the barrel (30) by plugging an end (22) of said guide rod or guide fork (21) into a rear end of the console (70), which faces the rear stock (12), said guide rod or guide fork (21) is guided in a non-rotational sliding manner in a in the rear stock (12), said breech cap (41), during firing, seals off a cartridge chamber constituted at the end of the barrel (30), thereby embracing a cartridge to be fired, said breech cap (41) being axially affixable in the barrel end (32) when the firearm (10) is being closed; and a locking unit (80) to lock the firearm in its closed position.

23. Firearm as claimed in claim 22, wherein the console (70) comprises a recess to receive the end (22) of the guide rod or guide fork (21).

* * * * *